United States Patent [19]

Hasler et al.

[11] Patent Number: 4,637,321

[45] Date of Patent: Jan. 20, 1987

[54] RETRACTABLE IRONING BOARD CONSTRUCTION

[75] Inventors: Georg Hasler; Rudiger Walz, both of Nagold, Fed. Rep. of Germany

[73] Assignee: Hafele KG, Fed. Rep. of Germany

[21] Appl. No.: 693,010

[22] Filed: Jan. 18, 1985

[30] Foreign Application Priority Data

Aug. 18, 1984 [DE] Fed. Rep. of Germany ..... 3430491

[51] Int. Cl.[4] ..... A47B 1/04

[52] U.S. Cl. ..... 108/72; 108/63

[58] Field of Search ..... 108/72, 71, 63, 90; 312/208, 28, 29, 322, 348

[56] References Cited

U.S. PATENT DOCUMENTS

| | | | |
|---|---|---|---|
| 916,849 | 3/1909 | Darrow | 108/63 |
| 1,040,255 | 10/1912 | Altermatt | 108/63 |
| 1,099,620 | 6/1914 | Samuelsen et al. | 108/71 |
| 1,295,438 | 2/1919 | Cordray | 108/63 |
| 1,728,917 | 9/1929 | Anderson | 108/72 |
| 1,985,620 | 12/1934 | Raphael | 108/72 |
| 2,492,842 | 12/1949 | Campbell | 108/63 |
| 2,590,341 | 3/1952 | Nabholz | 312/28 X |
| 2,650,442 | 9/1953 | Johnson | 108/63 X |
| 4,384,532 | 5/1983 | Staff | 108/72 |

*Primary Examiner*—Peter A. Aschenbrenner
*Attorney, Agent, or Firm*—McGlew and Tuttle

[57] ABSTRACT

The known built-in ironing boards are disposed on a pull-out which is movably mounted in ways so it can be swung via parallelogram guide arm pairs from a lower position at rest into an upper working position. When ironing on such an ironing board, the pull-out must be pulled out first, whereupon the ironing board must be brought into the working position and locked therein. To facilitate handling, there is now provided a naturally flexible member in the form of a flexible connector such as a wire rope which is effective only when the pull-out is extended, in which position it connects the ways, or a part fixed thereto, to the ironing board. Shortly before the end of the pull-out motion of the pull-out, the ironing board is retained by the wire rope so that the parallelogram guide arm pair pivots upwardly, bringing the ironing board into its working position without requiring additional manipulations to accomplish this.

11 Claims, 3 Drawing Figures

RETRACTABLE IRONING BOARD CONSTRUCTION

FIELD AND BACKGROUND OF THE INVENTION

This invention relates in general to ironing boards and in particular to a new and useful retractable ironing board construction for use with a work table or countertop.

The known built-in ironing boards are disposed in a closet or else under the table top of a work table. The ironing board itself is pivoted on a pull-out or draw through one or more pairs of parallelogram guide arms, the pull-out, in turn being movably mounted. The ironing board can thus be swung from a lower position at rest into an upper working position, it then usually being in one plane with the work table of the closet or of the table top. The movement from the one into the other position is accomplished either by springs or by hand. In both cases, a special locking arrangement is needed, at least in the upper working position, and the fittings used heretofore are relatively expensive.

SUMMARY OF THE INVENTION

The present invention provides a construction of an ironing board in which there is an automatic pivoting of the ironing board using simple fittings for pulling out a draw or pull-out assembly without the necessity to provide additional locking means. According to the invention, in its upper working position, the ironing board is fastened to the support of the draw or to a part fixed thereto by means of a naturally flexible member, in particular wire rope, effective when the draw is extended. If such an ironing board is pulled out of its position under the work table or table top by means of the draw, the flexible member retains the ironing board shortly before the end of the motion of the draw so that, upon continued pull-out motion, the guide arms swing upwardly, raising the ironing board into the upper working position. When retracting the draw, the process is reversed, and the ironing board lowers itself into its position at rest in accordance with the retraction motion of the draw. Special manipulations to raise or lower the ironing board are obviated by this design, and the additionally required mechanism comprises merely a simple wire rope.

To obtain the effectiveness of the naturally flexible member when the draw is extended, one may either use a wire rope corresponding at least to the extension length of the draw, or else fasten the member to a drag anchor. The latter is movably mounted in a rail with an end stop, the rail running along the direction of motion for the draw. The naturally flexible member becomes effective only after the drag anchor strikes the stop.

It is expedient for the guide arms to be arranged so as to pivot beyond their dead center position in the upper working position of the ironing board, supporting themselves indirectly or directly against a stop. If in such a position of the guide arms pressure is exerted upon the ironing board when ironing, a force component acting outwardly upon the draw results so that no unintentional retraction of the ironing board need be feared due to the ironing motions. The work table or table top may serve as the stop the rear edge of the ironing board abutting against this structure. It is also possible, of course, to provide stops acting directly upon the guide arms.

Most of the known ironing boards are foldable, the front portion being folded upon the rear portion in the position at rest. According to a further characteristic of the present invention, the front portion has a pivoting yoke or the like which, in the working position, hangs down freely and engages a detent on the draw. This fixes the position of the draw relative to the ironing board so that it is impossible to retract the draw inadvertently when the front portion is swung out. The detent consists preferably of a bevel and a retaining slot adjacent thereto, closed off by a front shield of the draw.

Accordingly, it is an object of the invention to provide an improved retractable ironing board construction which easily is erectable and includes a flexible element connected between the end of the extended ironing board and a drag anchor contained in a guide panel or way of a telescopic draw or which carries the ironing board such that the ironing board is held in an erected position until the board is to be collapsed.

A further object of the invention is to provide an improved ironing board which is extendible and retractable and which is simple in design, rugged in construction and economical to manufacture.

The various features of novelty which characterizes the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
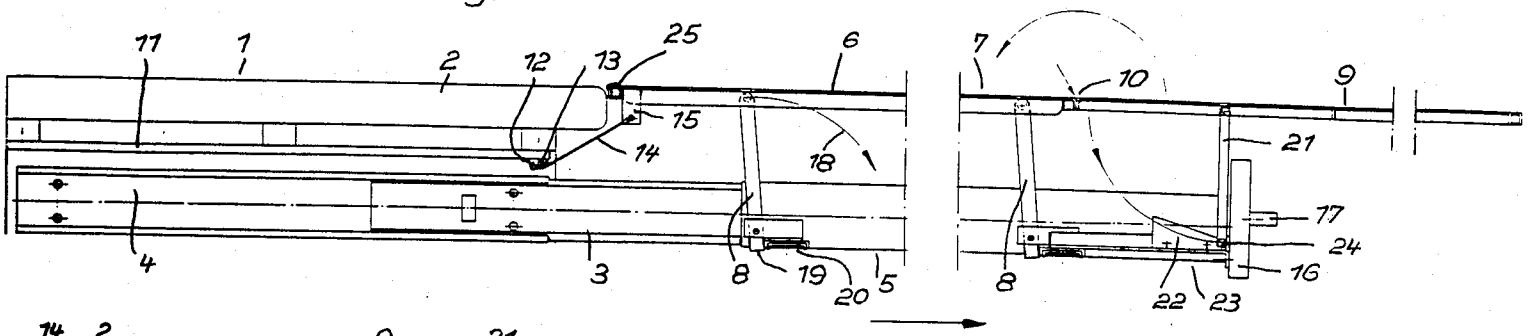
FIG. 1 is a broken-off sectional view of a work table with a built-in ironing board in the open position and constructed in accordance with the invention.

Referring to the drawing in particular the invention embodied therein comprises a retractable ironing board construction for use with a work table countertop 2. Mounted so as to be movable lengthwise in guides or tracks 4 underneath the table top 2 of a closet 1 is a telescope pull-out or draw member 3. Pivoted at the end portion 5 of the telescope pull-out or draw 3 by means of parallel pairs of guide arms 8 is the rear portion 6 of the ironing board 7.

Figure 2:
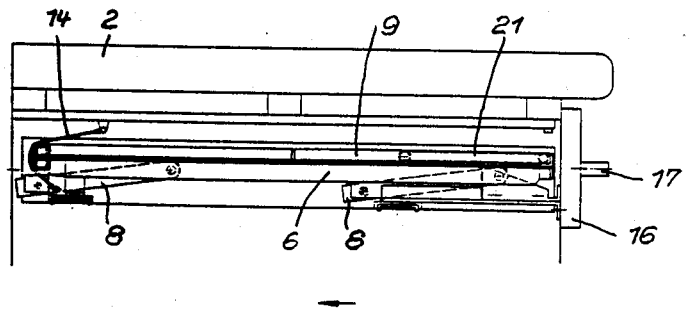
FIG. 2 is a view similar to FIG. 1 but in a closed position.

In the closed position shown in FIG. 2, the front portion 9 of the ironing board 7 is folded onto the rear portion 6, and both portions are in a lower position at rest. There is fastened above and parallel to the guides 4 a rail 11 in which a drag anchor 12 is movably mounted and whose end position is defined by an end stop 13 provided on the rail. By means of a flexible connecting member such as wire rope 14 the drag anchor 12 is fastened to a bracket 15 disposed at the rear portion 6 of the ironing board 7. The free end of the pull-out or draw member 3 is closed off by a shield or cover 16 with handle 17.

Figure 3:
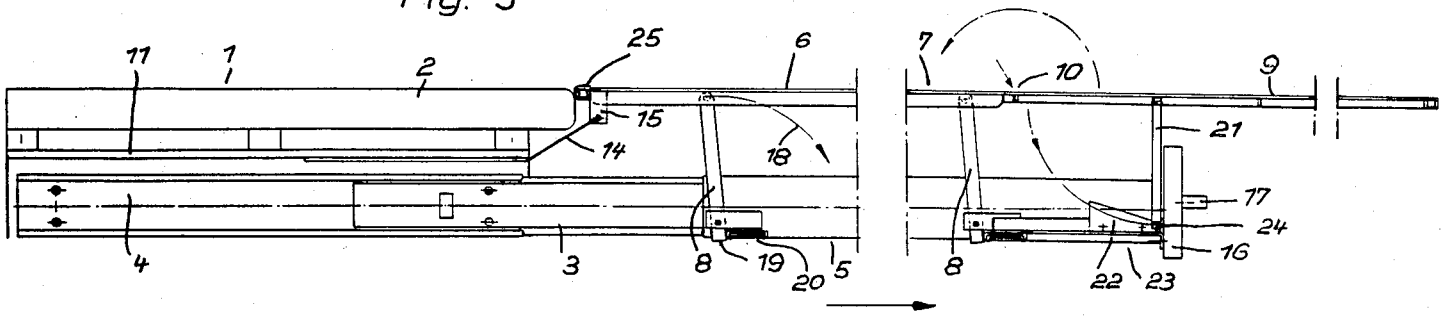
FIG. 3 is a view similar to FIG. 1 showing another embodiment of the invention.

If the pull-out 3 is pulled out of the rest position shown in FIG. 2 by means of the handle 17, the wire rope 14 pulls the drag anchor along toward the front in the rail 11 until it strikes the end stop 13. The ironing board 7 is then retained in its position and cannot move any further with the pull-out 3. Consequently the guide arms 8 pivot upwardly beyond dead center which is the vertical position for arms 8, in a direction opposite to the arrow direction 18, until their lower parts 19 contact the stops 20, at which time the working position is reached. At the same time, the rear edge 25 of the rear portion 6 of the ironing board 7 rests against the table top 2, thus forming a second stop. If pressure is exerted upon the ironing board 7 in this position, there emanates from the guide arm pairs 8 a force component in the pull-out direction so that there is no danger that the pull-out 3 is inadvertently retracted through the ironing motions. Wire rope 14 has a length being such that the wire extends taut between the rear end of the ironing board and the counter top when the ironing board is in its extended position. FIG. 3 shows the embodiment of the invention wherein one end of the wire rope is fixed near the middle of the rail 11.

Mounted to the front end 9 of the ironing board 7 is a pivoting yoke 21 which, in the position at rest according to FIG. 2, is located above the front portion 9. When the rear portion 6 of the ironing board 7 is in its working position following the pull-out motion, the front portion 9 is folded over to the front, the pivoting yoke 21 hanging down freely. It then slides across a bevel guide 22 of a detaining device 23 into a locking slot 24 which is closed off in front by the shield 16. The pivoting yoke 21 serves both to support the front portion 9 to prevent the pull-out from being pushed in inadvertently by the handle 17, for then the shield 16 would strike the pivoting yoke 21. The detent is released only by raising the front portion 9, making it possible to push the pull-out 3 back in again.

While a specific embodiment of the invention has been shown and described in detail to illustrate the application of the principles of the invention, it will be understood that the invention may be embodied otherwise without departing from such principles.

What is claimed is:

1. A retractible ironing board construction for use with a countertop extending at a horizontal level, comprising a longitudinally extending guide extending substantially parallel to the horizontal level and adapted to be positioned below the countertop, a draw member telescopically engaged with said guide for movement in a pull-out direction substantially parallel to the horizontal level, a plurality of parallel pivotal guide arms pivotally connected at spaced locations on said draw member, an ironing board pivotally connected to said guide arms and being movable between a collapsed position below the countertop and an extended position at the horizontal level when said draw is moved along said guide in said pull-out direction, said ironing board being substantially flush with and alongside the countertop in its extended position, anchor means mounted adjacent said guide, and a flexible member connected between said anchor means and said ironing board and being of a length to hold an end of said ironing board against an end of the countertop in said extended position of said ironing board, the length of said flexible member being selected so that with said ironing board in said extended position said flexible member is pulled taut between said ironing board and said anchor means.

2. An ironing board according to claim 1, wherein said flexible member comprises a wire rope, said anchor means including a guide rail extending along the length of said guide and a drag anchor connected to said flexible member and guided in said guide rail for motion in said pull-out direction.

3. An ironing board according to claim 1, wherein said ironing board has a rear edge which is positioned alongside the countertop in said extended position.

4. An ironing board according to claim 1, wherein said ironing board includes a rear portion adapted to lie adjacent the countertop in said extended position and a front portion which is hinged to said rear portion and may be extended substantially parallel to the rear portion in said extended position and folded over said rear portion in said collapsed position.

5. An ironing board according to claim 2, including an end stop formed at an end of said guide rail adjacent the end of the countertop for stopping motion of said drag anchor in said pull-out direction.

6. An ironing board according to claim 1, wherein said guide arms, ironing board and draw member form a parallelogram and, in the extended position, said arms beyond a vertical dead center position, and including a stop carried on said guide engaged behind a lower end of said guide arms below a pivotal point thereof.

7. A retractible ironing board construction for use with a countertop which extends at a horizontal level, comprising a guide connected under the countertop, a pull-out draw member mounted for movement in a pull-out direction to said guide, said pull-out direction being substantially parallel to the horizontal level, a plurality of parallel arms having lower portions pivotally connected to said draw member, and having upper portions, said lower portions being spaced from each other in said pull-out direction, an ironing board pivotally connected to said upper portions of said arms, said ironing board being movable with pivoting of said arms from a collapsed position under said countertop to an extended position substantially at the horizontal level of said countertop and next to said countertop, with movement of said draw in said pull-out direction, said ironing board having a rear end which is engageable with an end of said countertop in said extended position of said ironing board, and a flexible member connected between said rear end of said ironing board and the countertop and having a length for pulling said ironing board from its collapsed position to its extended position with movement of said draw in said pull-out direction, said length being such that said flexible member extends taut between said rear end of said ironing board and the countertop with said ironing board in its extended position.

8. A construction according to claim 7, including a rail connected under the countertop adjacent said guide and extending substantially parallel to said guide in said pull-out direction, a drag anchor slidably mounted to said rail in said pull-out direction, and an end stop fixed to said rail adjacent the end of the countertop for stopping movement of said drag anchor in said pull-out direction, said flexible member being connected between said rear end of said ironing board and said drag anchor.

9. A construction according to claim 8, wherein said flexible member comprises a wire rope.

10. A construction according to claim 8, wherein said ironing board, pull-out draw member and arms forms a parallelogram, said arms having a vertical dead center position on said draw member, said arms lying on one side of said dead center position in said collapsed position of said ironing board, and on an opposite side of said dead center position in said extended position of said ironing board, said flexible member pulling said ironing board through and beyond said dead center position with movement of said ironing board from its collapsed position to its extended position.

11. A construction according to claim 10, wherein said ironing board comprises a rear portion which carries said rear end and has a front end, and a front portion pivotally mounted to said rear portion at said front end thereof, said front portion being folded on said rear portion with said ironing board in its collapsed position and said front portion extending outwardly from said rear portion in said extended position of said ironing board, a pivoting yoke having one end pivotally connnected to said front portion of said ironing board and an opposite free end, and a detaining device connected to said pull-out draw member at a forward end thereof with respect to said pull-out direction for receiving said free end of said pivoting yoke with said pivoting yoke extending downwardly from said front portion of said ironing board, with said ironing board in said extended position.

* * * * *